United States Patent [19]

Rederon et al.

[11] 3,998,061

[45] Dec. 21, 1976

[54] FORMATION OF CAVITIES IN THE BED OF A SHEET OF WATER

[75] Inventors: Christian Jackie Rederon, Neuilly-sur-Seine; Gerard Pierre Souquet, Marly-le-Roi; Paul Louis Poulallion, Villepreux, all of France

[73] Assignees: C. G. DORIS (Compagnie Generale pour les Developement Operationnels des Richesses Sous-marines), Paris; Societe Francaise de Stockage Geologique GEOSTOCK, Courbevoie, both of France

[22] Filed: Mar. 24, 1975

[21] Appl. No.: 561,660

[30] Foreign Application Priority Data

Apr. 4, 1974 France ..... 74.12044

[52] U.S. Cl. ..... 61/88; 61/0.5; 61/50; 61/81

[51] Int. Cl.[2] ..... E02D 21/00

[58] Field of Search ..... 61/46, 46.5, 0.5, 1, 61/81, 50; 175/5, 9

[56] References Cited

UNITED STATES PATENTS

| | | | |
|---|---|---|---|
| 2,699,042 | 1/1955 | Hayward | 61/46.5 |
| 2,747,840 | 5/1956 | Miles | 61/46.5 |
| 2,756,021 | 7/1956 | Townsend et al. | 175/9 X |
| 3,886,753 | 6/1975 | Birdy et al. | 61/46.5 |

*Primary Examiner*—Jacob Shapiro
*Attorney, Agent, or Firm*—A. W. Breiner

[57] ABSTRACT

In order to form galleries or other subterranean cavities in the bed of a sheet of water, for example for the construction of a subterranean reservoir for storing petroleum, or for exploiting submarine deposits, a floating structure, comprising at least one and preferably two hollow shafts, is ballasted so that it rests upon the seabed or underwater surface, a bore is excavated in extension of each hollow shaft, down to the desired depth, a casing tube is inserted there, extending to above the sheet of water, and one of said casings is used as an access means for the excavation of the galleries or cavities, whilst the other if used to remove the spoil.

10 Claims, 9 Drawing Figures

38
1
2
39
35

4
36
11
11a
34
37
22
22a
23
33
32a
44a
33a
42
43
44
32
45

FORMATION OF CAVITIES IN THE BED OF A SHEET OF WATER

The present invention relates to the formation of galleries or other subterranean cavities in the bed of a sheet of water, and relates in particular to the creation of subterranean reservoirs for the storage of hydrocarbon products in the neighbourhood of off-shore rigs. However, it goes without saying that the invention is equally applicable to the creation of galleries or underwater cavities for some other purpose, for example for the exploitation of mineral deposits.

It is well known to form galleries or similar excavations beneath a sheet of water. Galleries of this kind have existed for many years now, in particular in Great Britain where mining galleries extend beneath the sea. There are also road or rail tunnels beneath the sea, in particular in Japan. Using the known methods, access is gained to the earth beneath the seabed, by digging out galleries or excavations from shafts or tunnels formed on land. Accordingly, the facility to exploit submarine substrata is restricted to regions located very close to the coastline; the formation of an access tunnel from the land to a point located at a long distance from the coast, will in other words involve a prohibitive outlay.

The object of the present invention is to provide improvements which make it possible to gain direct access, without the intermediary of a tunnel starting from the land, to the submarine substrata, and there to form galleries or other cavities, this virtually throughout the extent of the continental shelves, that is to say whatever the distance from the coastline and down to a water depth of around 300 meters, that is to say the maximum depth from which at present it is possible to extract hydrocarbon products, and, in a more general way, the maximum depth at which practical extraction of submarine deposits is conceivable.

To this end, in accordance with the invention, a floating structure is built, comprising at least one hollow shaft having a height greater than the depth of the sheet of water at the location where the excavation is to be made, the structure is transported to said location and is then ballasted so that the base of the shaft rests on the underwater surface, a bore is sunk in extension of the hollow shaft, until a stratum is reached which is suitable for the storage function, the bore is cased and the hollow shaft likewise, in a watertight fashion, to a point above the level of the sheet of water, the water is pumped out of the bore and the hollow shaft, and said shaft and bore are then used as means of access for the excavation of galleries or other cavities in said suitable stratum.

The bore will preferentially be formed from the hollow shaft by a big-hole type drilling process. However, it is within the scope of the invention to form the bore by other means; for example, if the nature of the ground requires or permits, explosives can be used.

Preferentially, the floating structure will comprise two hollow shafts respectively used to form two bores, one of which is employed as an access to the excavation works, and the other as a route by which to evacuate the spoil and as an emergency escape route. The hollow shaft or shafts will advantageously be surrounded by a hollow column of larger diameter which protects them and supports one or more working platforms or decks above it or them.

To enable the bore to be drilled and the galleries or cavities in the submarine substratum to be excavated, it is necessary, of course, for the structure to rest upon the bed of the sheet of water in a highly stable fashion, without any risk of toppling or displacement under the effect of wave action and bad weather. Advantageously, a structure of the "weighted base" type will be used, comprising a suitably ballasted base which bears down heavily upon the underwater surface and, consequently, stands up well to the toppling moment produced by wave action. The stability vis-a-vis drift over the underwater surface, can be provided by the use of "spades" which penetrate to a greater or lesser depth into the underwater surface, depending upon the nature of the latter.

In one embodiment, the base of the structure comprises a slab forming a raft resting upon the bed, and the hollow shaft or shafts extend (s) beneath said raft in the form of a portion which penetrates into the underwater surface.

The description which now follows in relation to the attached drawings, given by way of non-limitative examples, will enable the advantages of the invention to be understood and also the method by which it is executed.

Figures 8, 8A:
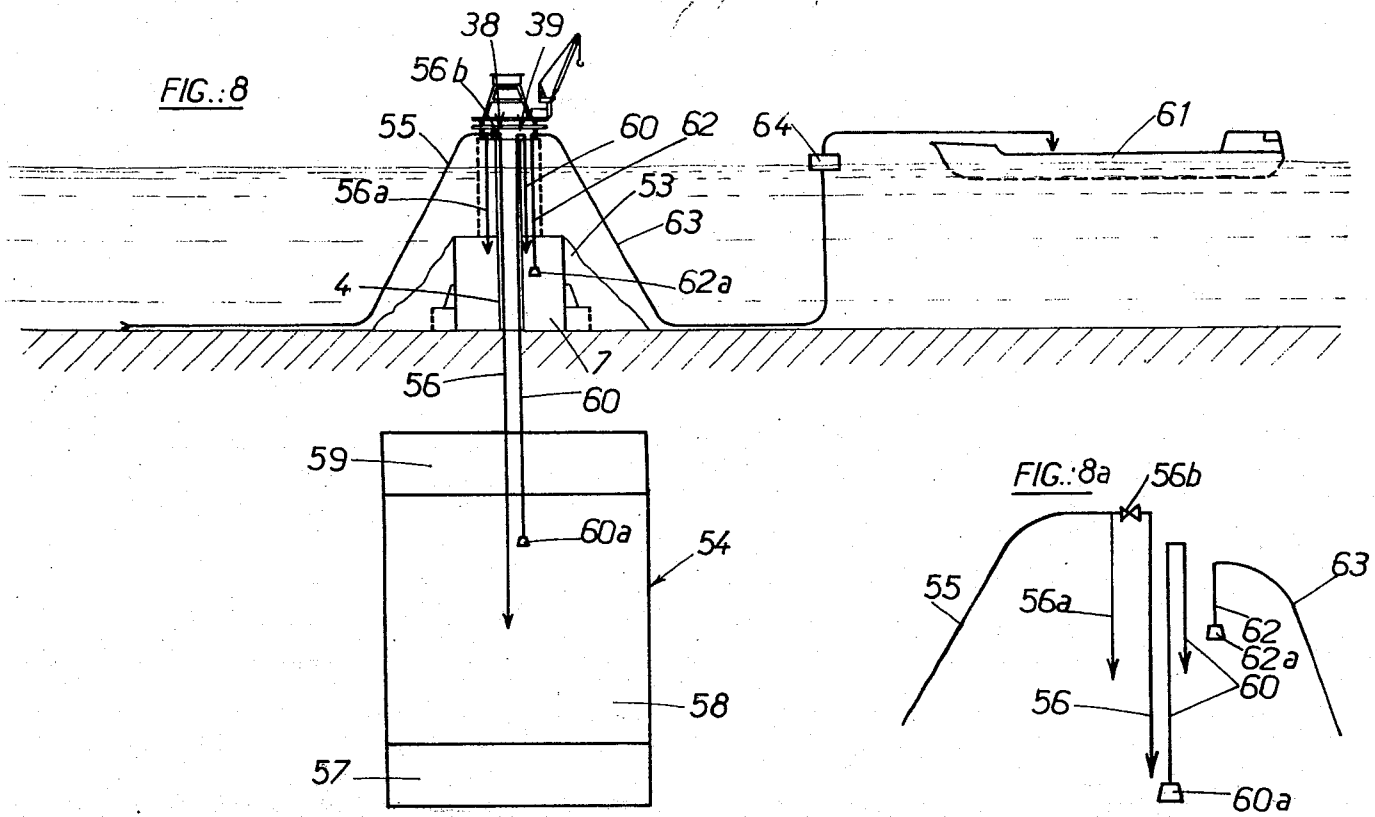
FIG. 8 is a schematic sectional view on a very much smaller scale, illustrating the way in which the storage reservoir is utilised.

FIG. 8*a* is a schematic, enlarged view of a detail of FIG. 8.

The drawings illustrate by way of example, the production of a subterranean storage reservoir in the neighbourhood of an offshore petroleum-producing well (not shown).

The structure shown in FIGS. 1 to 4 is designed to support and protect, from the time of commencement of their construction and up to the end of the works involved in forming the subterranean storage reservoir and thereafter during the operation of the reservoir, two vertical hollow shafts 1, 2 which make it possible to excavate bores which provide access for the formation of the reservoir. This structure comprises a slab forming a raft 3 which centrally supports a hollow vertical cylinder 4 and, around same, a lobed wall 5 which, between the raft 3 and an annular slab 6 surrounding the cylinder 4, delimits a vast, watertight annular chamber 7. The raft 3, furthermore, around the lobed wall 5, supports a perforated wall 8 of low height, which is attached to the wall 5 by vertical buttresses 9 containing openings 10.

In the embodiment illustrated, the water depth at the location at which the galleries are to be excavated, is aroung 140 meters above a layer 11 of silt, around 6 meters thick, covering a sand base in a region 12 and a clay base in a region 13. The hollow cylinder has a diameter of 20 meters and a total height of 170 meters; its upper portion is surrounded by a perforated cylindrical wall 24, 50 meters in diameter which rests upon the annular slab 6. Two superimposed decks are supported, well above the surface of the water 15, by columns 18, 19 resting respectively upon the cylinder 4 and upon the perforated wall 14. These two bridges are designed to carry excavating equipment and equipment for exploitation, which will be described hereinafter. The hollow shafts 1 and 2 have a diameter of 4.5 meters; they are supported at their bases by the raft 3 and at their tops by the decks 16 and 17; the hollow shafts pass through these two decks; they also pass through the shaft 3 and extend a little beneath it, in the form of portions 1*a*, 2*a*, for a reason which will be indicated hereinafter.

The building of the structure, its transportation and the method of positioning it at the desired location, do not form part of the invention; these aspects are well known per se and there does not therefore appear to be any point in a detailed description of them here. The structure is made of concrete, in the embodiment illustrated, and its construction can be commenced on land in a dry dock, which is filled with water as soon as the initial structure is capable of floating, thereafter being transferred afloat to a projected location of sufficient depth. The annular chamber 7 acts as a float chamber enabling the structure to ride in the water in a stable fashion without too deep a draught; accordingly, it can be towed to the location chosen and ballasted, for example by discharging ballast (shingle, sand or gravel) into the cylinder 4, between the wall 5 and the perforated wall 8, and possible between the cylinder 4 and the perforated wall 14. This perforated wall 8 is essentially designed to protect the structure against undermining of the seabed or the like by the water, in the manner described in Canadian patent application No. 179,637 and the perforated wall 14 is designed to form in relation to the cylinder 4, a perforated annular caisson doing duty as a wave breaker.

Figure 1:
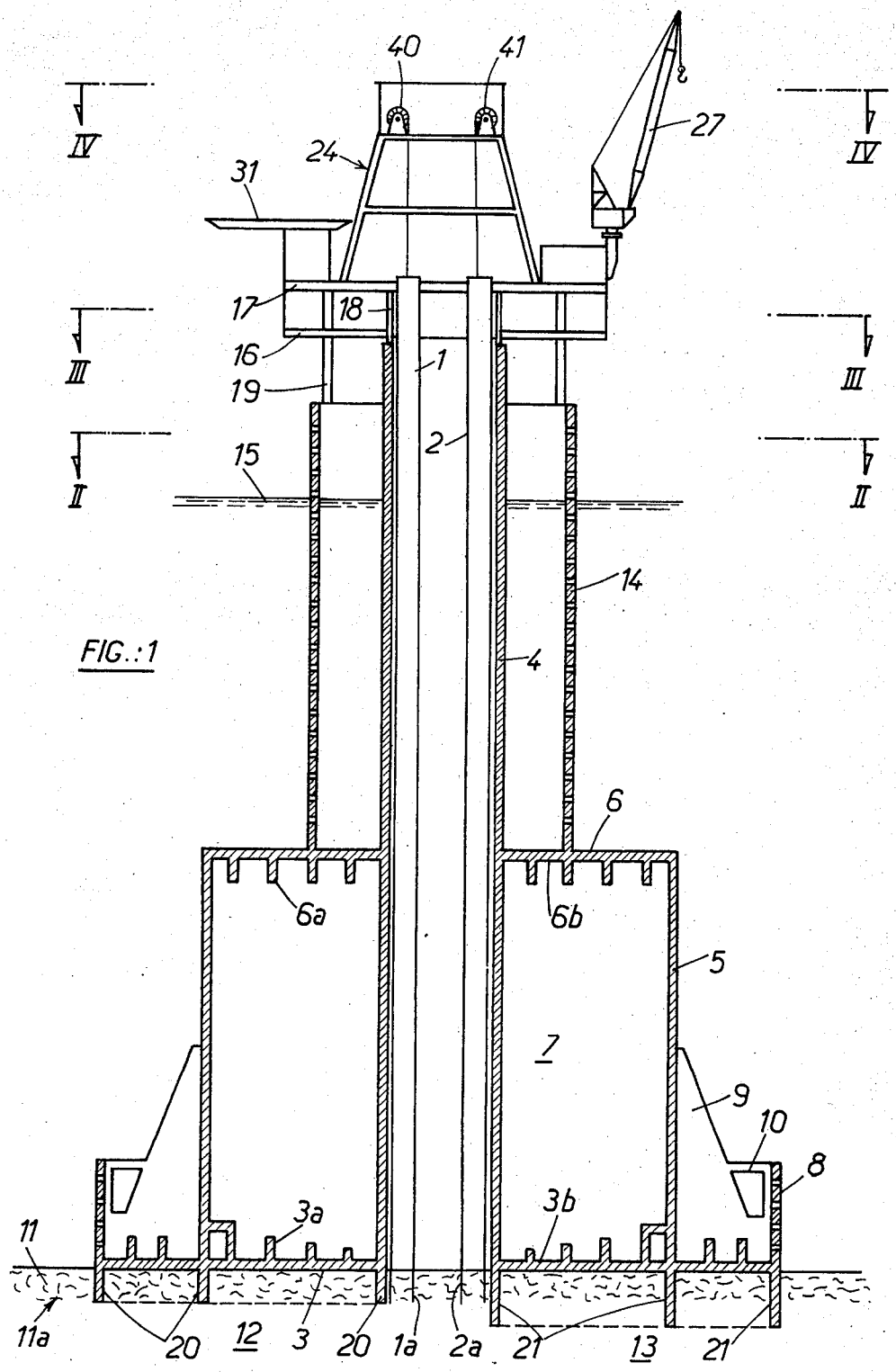
FIG. 1 is a vertical section through a structure resting upon the seabed and comprising two vertical hollow shafts used to excavate two access bores.
Figure 2:
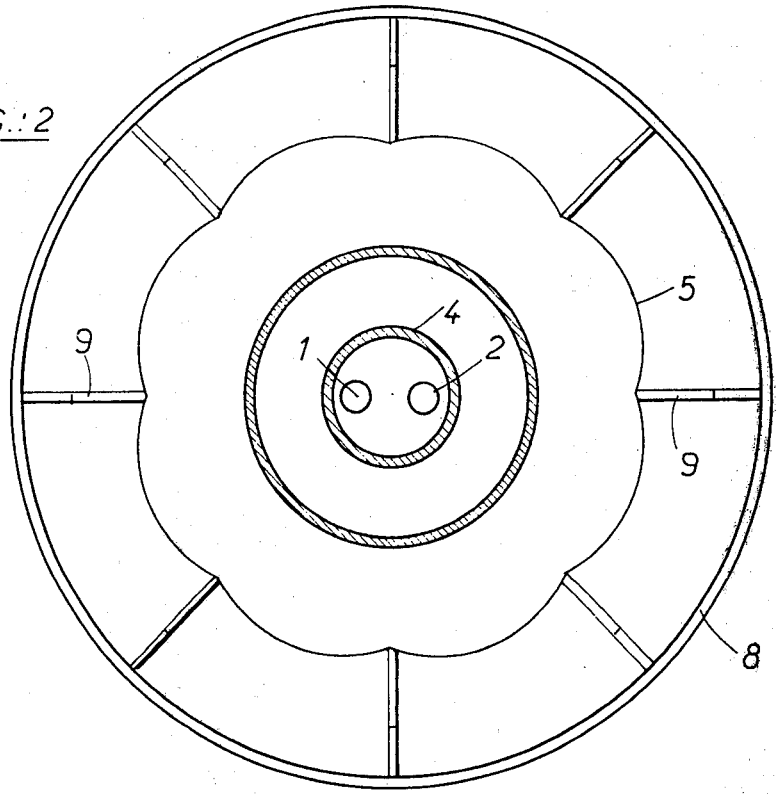
FIGS. 2, 3 and 4 are sectional views, on the lines II—II, III—III and IV—IV, respectively, of FIG. 1.
Figure 3:
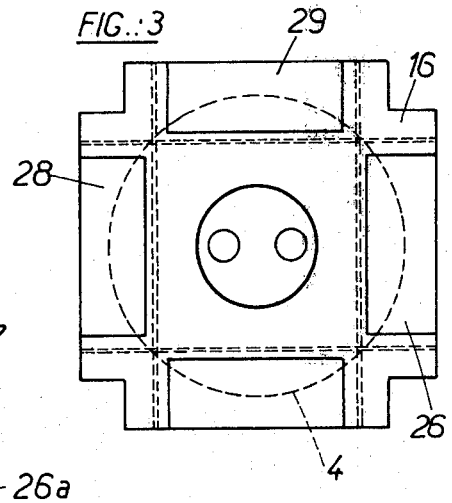
Figure 4:
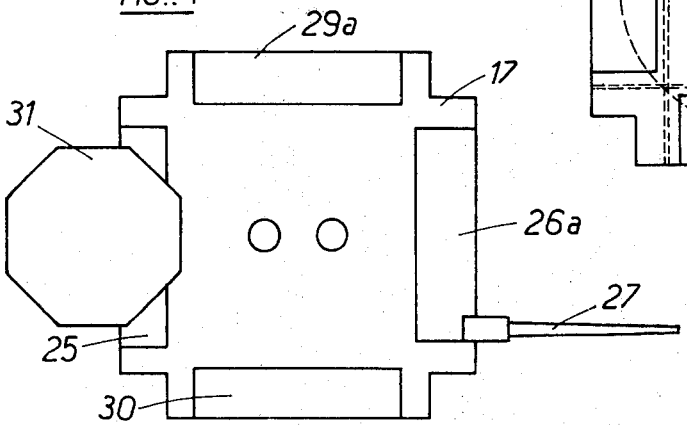

The ballast has not been shown in FIG. 1; the whole of its weight acts upon the base formed by the slab 3, and applies the latter firmly against the underwater surface or seabed, thus preventing the structure from toppling as as consequence of wave action. The slab 3 is furthermore provided, beneath each of the walls 4, 5 and 8, with "spades" of various heights which dig to a greater or lesser depth into the underwater surface, depending upon the nature of the latter, in order to prevent the structure from drifting over same. Also, at 20 "spades" which simply pass through the slit layer 11 above the sand stratum 12, can be seen, and likewise at 21 "spades" of greater height which penetrate into the clay stratum 13. The hollow shaft sections 1*a* and 2*a*, located beneath the slab 3, penetrate into the slit layer 11 and cooperate with the spades 20, 21 in limiting penetration of water into the zone located beneath the hollow shafts 1, 2 where the bores are to be sunk in the manner described later on. The slabs 3 and 6 are stiffened by webs 3*a* and 6*a* respectively on the top 3*b* and bottom 6*b* faces.

Once the structure is set up in the position shown in FIG. 1, in the seabed or the like two bores 22 and 23 (FIGS. 5 and 6) stretching respectively in extension of the hollow shafts 1 and 2, are formed, and these bores are used as a means of access for the excavation of the storage reservoir in an impermeable layer of the substratum, as well as a means of evacuating the spoil. However, the structure is likewise arranged to make it possible, during the execution of the works, to carry out the exploitation of production wells (not shown) by utilizing the annular chamber 7 as a storage dump for the loading of tankers. The decks 16, 17 must therefore not only carry the equipment for the exploitation operation, but also that for carrying out the excavation works, this equipment primarily comprising an excavator head 24 and a drill rig (not shown) which is readily compatible with the excavator head. A schematic illustration has been provided of some of the exploitation equipment, namely, at 25, accomodation for the personnel, at 26 and 26*a*, a power plant, at 27, a derrick, at 28 repair workshops, at 29 and 29*a*, production equipment proper, at 30, auxiliary installations, and at 31*a* helicopter landing pad.

Figure 5:
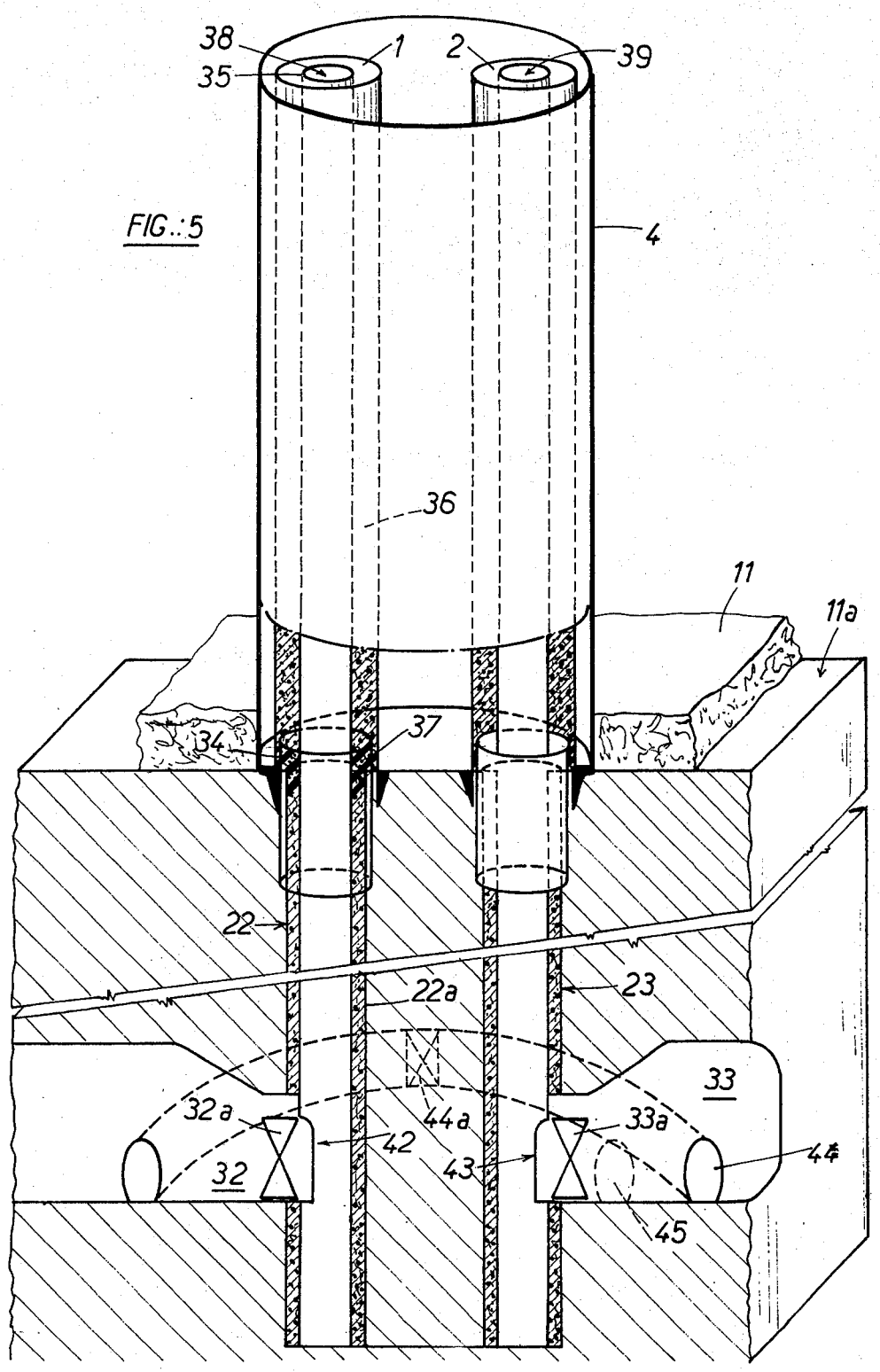
FIG. 5 is a perspective view on a larger scale, cut away and partially in section, showing the execution of the access bores and the galleries.
Figure 6:
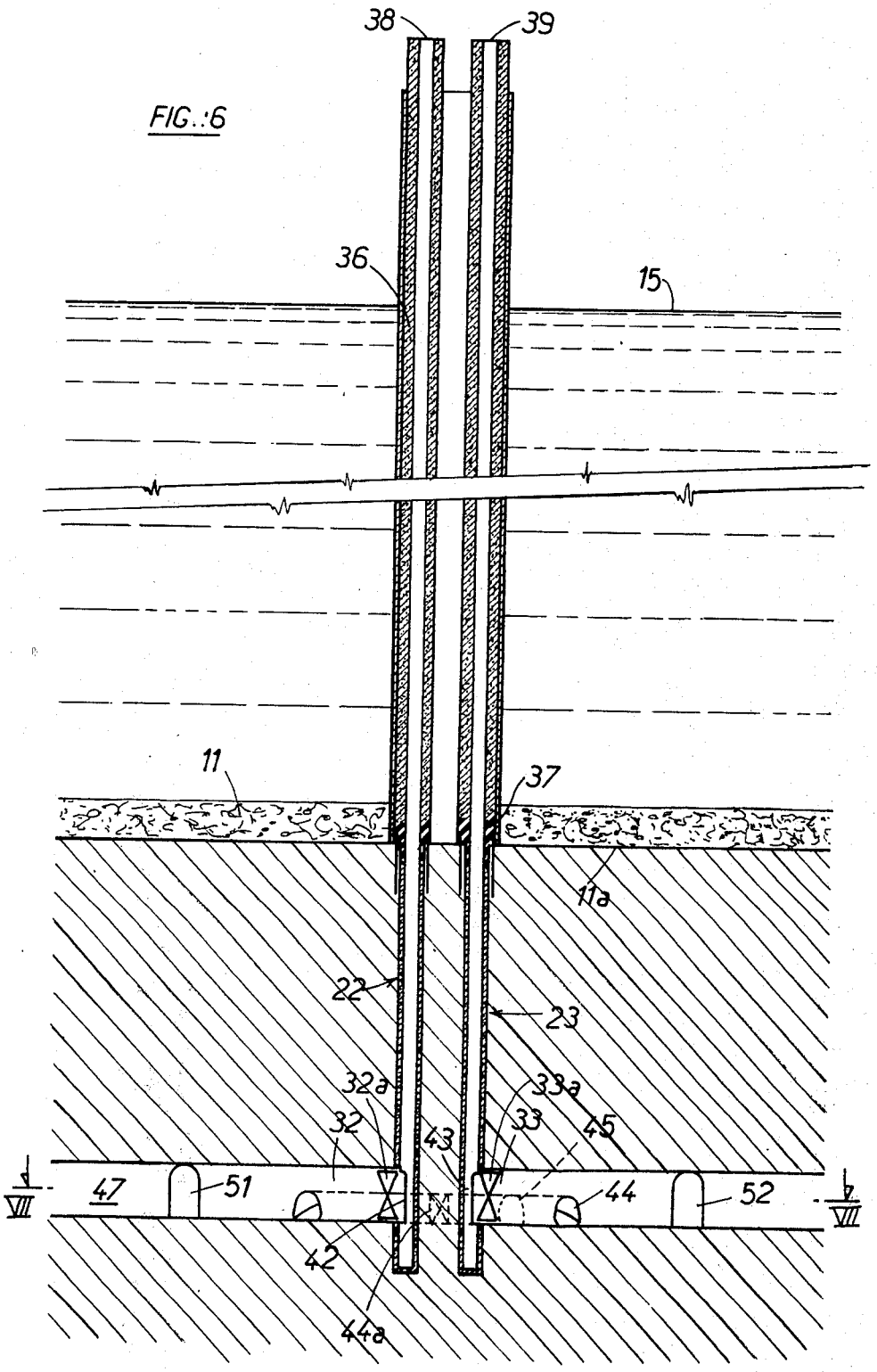
FIG. 6 is a fragmentary view similar to that of FIG. 1, illustrating the arrangement of the storage galleries and the access to them.

FIGS. 5 and 6, in which, of the structure only the hollow shafts 1 and 2 and the cylinder 4 over part of their height, have been shown, schematically illustrate the bores 22, 23 and the galleries 32, 33, providing access to the subterranean storage reservoir.

The two bores are formed in an identical fashion and we can confine ourselves to a description of the production of the bore 22. Operations are started by engaging in the hollow shaft 1 a section of tube 34*a* 4.40 meters in diameter and some 10 meters long, which is driven into the seabed or the like by means of a pile driver which has not been shown. Subsequently, this section of tube 34 is used as a guide tube in order to excavate the bore 22 by a big-hole type drilling process, down to a depth of around 80 meters beneath the bottom limit 11*a* of the silt layer 11, that is to say, in the chosen example, down to a stratum which is suitable for the storage function. Those skilled in the art will be well familiar with the technique of big-hole type drilling, and this requires no further description here.

Subsequently, a tube 35 which is 3.5 meters in diameter, is positioned in the hollow shaft 1 and the bore 22, and extends from the bottom of the bore 22 to the top of the shaft 1. This tube 35 is designed to form a watertight sheath and is referred to as "casing" in the art; it should have a suitable thickness and can have suitable reinforcing means constituted in particular by suitably spaced horizontal rings (not shown). Subsequently, the annular space 36 surrounding the casing 35 is cemented using known techniques but using as cement, in a zone 37 of said annular space which extends over a height of around 3 meters above and below the level of the bottom limit 11*a* of the base layer, polymers which swell in contact with water. Thus, a layer of flexible cement is formed which enables the casing to distort elastically preventing it from shearing in the event that the structure executes a slight movement. The water is then discharged from the casing by pumping.

When the two bores 22, 23 have thus been excavated and equipped, each of them forms, with the corresponding hollow shaft 1, 2, a vertical passage 38, 39 (FIGS. 6 and 7) linking the decks 16, 17 with the appropriate level in the submarine substratum. These two passages are utilized to excavate the subterranean reservoir, the first passage 38 (constituted by the shaft 1 and the bore 22) essentially being used for movement of personnel and materials, and the second 39 (shaft 2 and bore 23) essentially being used to evacuate the spoil. To this end, the first passage 38 is equipped with means which have not been shown, comprising for example a lift for the personnel, a ventilation system, water, electrical and compressed air lines (supplied from the plant 26, 26a) a pumping system, an emergency escape ladder and a winch (schematically illustrated at 40 in FIG. 1) for lowering and raising equipment. The second passage 39 is served by the winch 41 of the excavator head 24, and is furthermore equipped with an emergency escape ladder which has not been shown.

Figure 7:
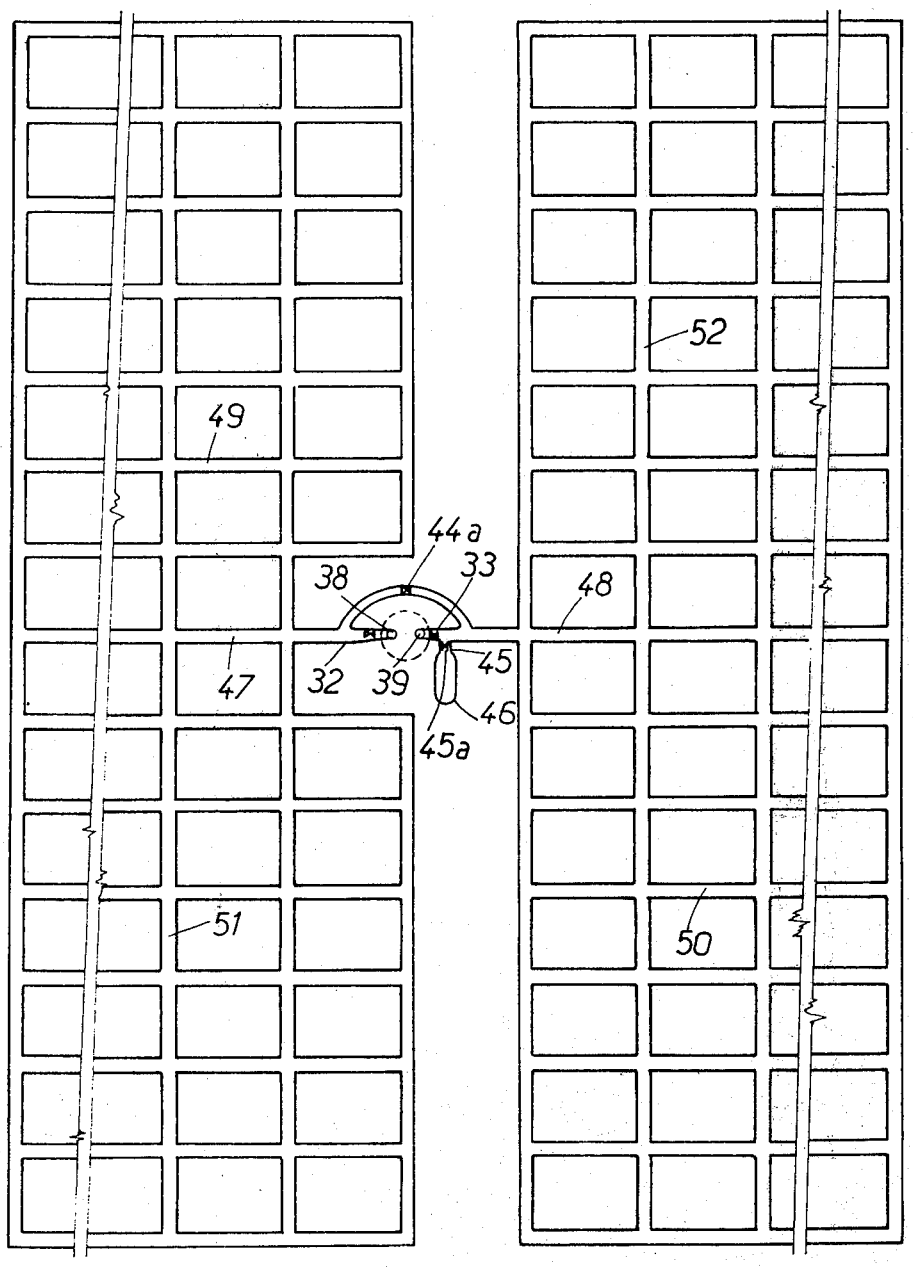
FIG. 7 is a sectional view on a smaller scale, on the line VII—VII of FIG. 6.

However, in order for the passage 38 and 39 to be able to be operated in this way, the starting point must be the provision of a link between the two at the bottom. Thus, a start is made by cutting openings 42 and 43 in the casings of the two bores, and excavating the access galleries 32 and 33 which ae connected with one another by a communicating gallery 44. These galleries are equipped with emergency airlocks 32a, 33a and 44a, with watertight doors which will withstand the pressure of a column of water reaching up from their level to the surface of the sea. Then, from the access gallery 33, a short gallery 45 (FIG. 7) is excavated, terminating in a chamber 46 which is intended to serve as an emergency escape room. The short gallery 45 is equipped with an emergency airlock 45a which makes it possible to isolate the chamber 46 in the case of an emergency, the chamber 46 being equipped with independent systems (not shown) for the survival of personnel reaching it until rescue measures can be implemented. Finally, from the access galleries 32 and 33, a subterranean reservoir represented in FIGS. 6 and 7 is excavated, this like conventional subterranean storage reservoirs located on land, being constituted by a network of criss-crossing galleries. This network or grid, comprises two galleries 47 and 48 respectively forming extensions of the access galleries 32 and 33, a plurality of uniformly-spaced galleries such as those 49 and 50 parallel to the galleries 47 and 48, and a plurality of uniformly-spaced galleries such as those 51 and 52 which intersect the former galleries at right angles in order to form two independent dump halves.

In order to prevent substantial penetration of water, something which there is always a risk of because of the steep hydrodynamic gradients existing in the submarine substrata, the excavating of the galleries is carried out by a technique of tunnel-driving which employs the injection of cement in front of and around the cutting face. A technique of this kind is well known per se and requires no further description here. As they advance, the galleries are fitted with conveyor belts which have not been shown, in order to automatically remove the spoil to the base of the vertical passage 39. The spoil is then discharged by means of the extraction winch 41 (FIG. 1) or by some other mining technique, and dumped on the seabed around the lobed wall 5 in order, at 53 (FIG. 8) to act as a supplementary anchorage for the platform and, if required, to provide protection against icebergs in the underwater zone.

FIG. 8 illustrates a method of exploiting the underground storage reservoir schematically illustrated in FIG. 54, once its construction has been completed. A pipeline 55 coming from the well head which has not been shown, is connected to a pipeline 56 which extends through the passage 38 and terminates in the subterranean reservoir 54, where it discharges above a seawater layer 57, petroleum 58 above which there is a layer of gas 59. A branch 56a from the pipeline 56, and controlled by a valve 56b, this branch passing outside the cylinder 4, makes it possible to discharge petroleum directly into the transfer volume 7. Another pipeline 60, rising from the subterranean reservoir 54 through the passage 39 and descending again outside the cylinder 4, makes it possible through a filter 57a, to pump petroleum at 58 into the reservoir 54 and to discharge it into the transfer volume 7. It is from the latter that oil tankers such as 61, are loaded through a pipeline 62 equipped with a filter 62a, said pipeline rising outside the cylinder 4 and being attached to a pipeline 63 terminating at a buoy 64 constituting a conventional loading point. The elements 55, 56a, 62, 63 and 64 will have been installed prior to or during the carrying out of the excavation of the subterranean reservoir, so that it will have been possible to utilise the structure in order to commence exploitation of the producing well, in the manner indicated hereinbefore.

Self-evidently, FIG. 8 is only schematic in nature and the exploitation of the subterranean reservoir requires appropriate equipment which will be familiar to those skilled in the art. Such equipment does not form part of the invention and has neither been described nor illustrated here. In particular, to extract petroleum from a subterranean reservoir, at the bottom of the bores, suitably powerful pumping installations will be installed. This is why the openings 42 and 43 (FIG. 6) are made at a certain distance (8 to 10 meters in the embodiment shown) above the bases of the bores.

It goes without saying that the embodiment described is purely an example and is open to modification, in particular by the substitution of equivalent techniques, without in so doing departing from the scope of the invention, as defined in the appended claims. In particular, in the case where the exploitation of the subterranean galleries or cavities does not require the presence of the structure, this could be ballasted by the introduction of water into the internal volumes, and then the ballast blown by pumping the water out after the execution of the works, following which the structure could be towed away and re-used at another location. In this case, of course, the spoil will not be dumped around the structure. Similarly, if the materials extracted from the underground workings are useful, for example minerals, then they will not of course be dumped on the seabed.

We claim:

1. A method of forming galleries or other subterranean cavities in the bed of a sheet of water comprising the steps of a. providing a floating structure at a location where galleries or cavities are to be formed comprising two hollow shafts having a height greater than the depth of the sheet of water at the location where said galleries or cavities are to be formed, said two shafts serving respectively for the execution of two bores one of which is used for access to the galleries or cavity excavations, and the other for the discharge of the spoil and as an emergency escape route;

b. ballasting said floating structure where said galleries or cavities are to be formed in order that the base of the hollow shaft rests upon the underwater surface;

c. excavating two bores in extension of said hollow shafts down to the desired depth;

d. casing said bores and hollow shafts in watertight fashion up to a point above the level of the sheet of water;

e. pumping the water out of the casings; and f. excavating two access galleries or cavities starting respectively from said two bores and linking said galleries or cavities by a communication gallery, emergency airlocks being installed in the access galleries and in the communication gallery.

2. A method as claimed in claim 1, in which the bore is excavated by a big-hole type drilling process.

3. A method as claimed in claim 2, in which the excavation of the bore comprises the steps of engaging a section of casing tube in the hollow shaft; pile-driving the casing section into the seabed or underwater surface, and utilizing the casing section as a guide tube for the drilling of the large-diameter bore.

4. A method as claimed in claim 1, in which the annular space surrounding the casing is cemented, using by way of cement, in a zone of said annular space adjacent to the level of the underwater surface, polymers which swell in contact with water.

5. A method as claimed in claim 1, in which an opening is cut in the casing and the galleries or cavities are excavated from said opening.

6. A method as claimed in claim 1, in which, from one of the access galleries, an emergency refuge chamber, protected by an emergency airlock, is excavated.

7. A method as claimed in claim 1, in which the spoil is discharged around the base of the structure.

8. A method as claimed in claim 1, in which the floating structure comprises a hollow column surrounding and protecting the hollow shaft or shafts and supporting one or more working platforms above the said hollow shaft or shafts.

9. A method as claimed in claim 1, in which the structure is provided with a base designed to rest upon the seabed or underwater surface, and in which the hollow shaft or shafts extend(s) beneath said base in the form of a portion penetrating into the seabed or underwater surface.

10. A method as claimed in claim 9, in which said base is provided with "spades" which also penetrate into the seabed or underwater surface.

* * * * *